US006854361B2

(12) United States Patent
Vandergaw

(10) Patent No.: US 6,854,361 B2
(45) Date of Patent: Feb. 15, 2005

(54) JAR OPENER

(76) Inventor: Dale W. Vandergaw, 4840 Eastcliff Ct., San Diego, CA (US) 92130

( * ) Notice: Subject to any disclaimer, the term of this patent is extended or adjusted under 35 U.S.C. 154(b) by 0 days.

(21) Appl. No.: 10/075,468

(22) Filed: Feb. 13, 2002

(65) Prior Publication Data

US 2003/0150296 A1 Aug. 14, 2003

(51) Int. Cl.[7] ..... B67B 7/14

(52) U.S. Cl. ..... 81/3.4; 81/3.44; 81/3.07; 81/3.42; 81/3.37; 81/3.56

(58) Field of Search ..... 81/3.4, 3.44, 3.07, 81/3.42, 3.37, 3.56

(56) References Cited

U.S. PATENT DOCUMENTS

| | | | | | |
|---|---|---|---|---|---|
| 4,052,917 | A | * | 10/1977 | Gee | 81/3.42 |
| 4,306,470 | A | * | 12/1981 | Woloszyn | 81/3.42 |
| 5,325,741 | A | * | 7/1994 | Astrom | 81/3.37 |
| D350,264 | S | * | 9/1994 | Friend | D8/43 |

* cited by examiner

*Primary Examiner*—Joseph J. Hail, III
*Assistant Examiner*—Alvin J Grant
(74) *Attorney, Agent, or Firm*—Procopio, Cory, Hargreaves & Savitch LLP

(57) ABSTRACT

A Jar Opener includes a beam, a handle, a fixed jaw, and a movable jaw. The Jar Opener is able to securely clamp a jar lid between the fixed jaw and the movable jaw, and the beam and handle are then turned to open the jar. The Jar Opener functions as a lever arm to enable any user to easily open virtually any twist top jar.

17 Claims, 5 Drawing Sheets

JAR OPENER

FIELD OF THE INVENTION

The present invention relates generally to kitchen utensils. More specifically, the present invention pertains to a tool for use in opening jars. The present invention is particularly, though not exclusively, useful for opening virtually any twist top jar.

BACKGROUND OF THE INVENTION

Everyone has, at one time or another, encountered a jar they could not open. The jars which we purchase at the local supermarket are vacuum sealed to maintain the freshness of the jar's contents. Unfortunately, the process of sealing the jar can often lead to a seal that is extremely difficult to break. If a person is physically unable to open a jar, they will either have to seek out someone who can open the jar, or go without opening it. Consequently, there is a need for a jar opener which will enable any user to easily open virtually any twist top jar.

Accordingly, it is an object of the present invention to provide a Jar Opener that is able to easily and effectively open virtually any twist top jar. It is another object of the present invention to provide a Jar Opener that is adjustable for use with virtually any size jar.

SUMMARY OF THE INVENTION

In accordance with the present invention, a Jar Opener is provided and includes a beam, a fixed jaw, a movable jaw which slides along the beam, and a handle. The Jar Opener may be used to open a twist top jar by gripping the jar lid between the fixed jaw and movable jaw, and then by turning the beam and handle. The beam and handle extend radially from the lid to provide a lever arm for twisting the jar lid. The distance between the fixed and movable jaws may be adjusted so that the Jar Opener may grip lids with a variety of diameters. The handle includes a pin which fixes the movable jaw in place when the handle is closed, and allows the movable jaw to slide along the beam when the handle is open. Therefore, the movable jaw may be easily slid along the beam in order to secure a lid between itself and the fixed jaw. The movable jaw may then be fixed in place to securely hold the lid.

The Jar Opener as described above will enable a user to easily open virtually any twist top jar.

DESCRIPTION OF THE DRAWING

The novel features of this invention, as well as the invention itself, both as to its structure and its operation, will be best understood from the accompanying drawings, taken in conjunction with the accompanying description, in which similar reference characters refer to similar parts, and in which.

DETAILED DESCRIPTION

Figure 1:
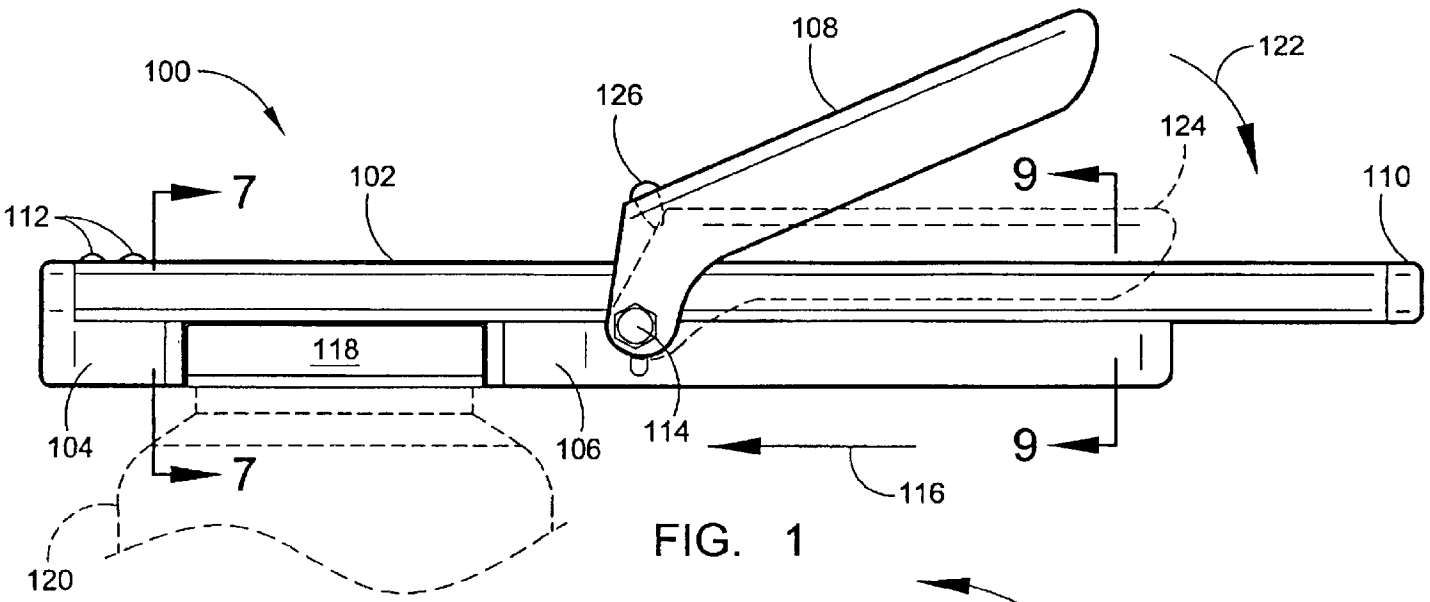
FIG. 1 is a side view of the Jar Opener of the present invention shown engaging the lid of a jar.

Referring initially to FIG. 1, the Jar Opener 100 of the present invention is shown and includes beam 102, fixed jaw 104, movable jaw 106, handle 108, and end plug 110. Fixed jaw 104 is fixed to one end of beam 102 by screws 112. Movable jaw 106 is moveably affixed to beam 102, discussed in conjunction with FIG. 9. Handle 108 is affixed to movable jaw 106 by fastener 114. End plug 110 is affixed to beam 102 by inserting end plug 110 into beam 102 at the end opposite to fixed jaw 104. Movable jaw 106 may be advanced in direction 116 to contact lid 118 of jar 120. Movable jaw 106 is then clamped in place by moving handle 108, in direction 122, until handle 108 is in closed position 124. When handle 108 is in closed position 124, camming pin 126, discussed in connection with FIG. 2, prevents handle 108 from moving, thereby maintaining contact between movable jaw 106 and lid 118.

In a preferred embodiment, beam 102 and handle 108 may be constructed of aluminum, however, it should be noted that beam 102 may be constructed of any material having similar strength that is well known in the art. Fixed jaw 104, movable jaw 106, and end plug 110 may be constructed of hard plastic, but may also be constructed of any other material well known in the art. It is important to note that in a preferred embodiment, movable jaw 106 and handle 108 have grip surfaces which are textured to give a user with wet or slippery hands a tight grip. The textured surfaces of movable jaw 106 and handle 108 may also be grooved or other texture type used in the art. In an alternative embodiment, movable jaw 106 and handle 108 may have smooth surfaces. Fastener 114 may be nut and bolt, rivet, or other fastener used in the art.

Figure 2:
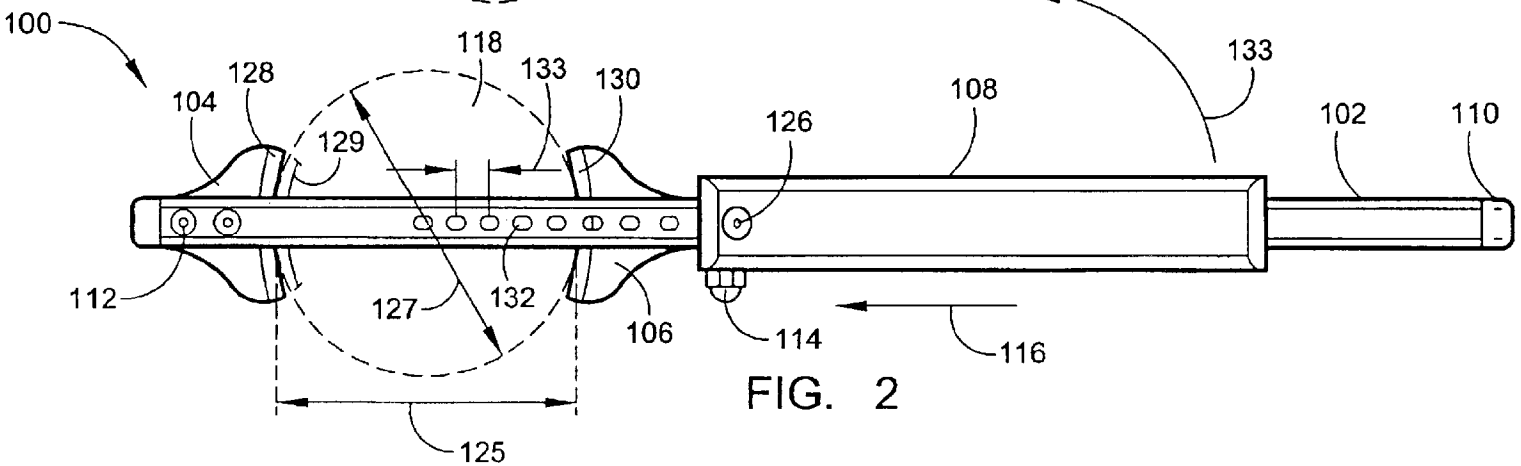
FIG. 2 is a top view of the Jar Opener of the present invention shown in use.
Figure 3:
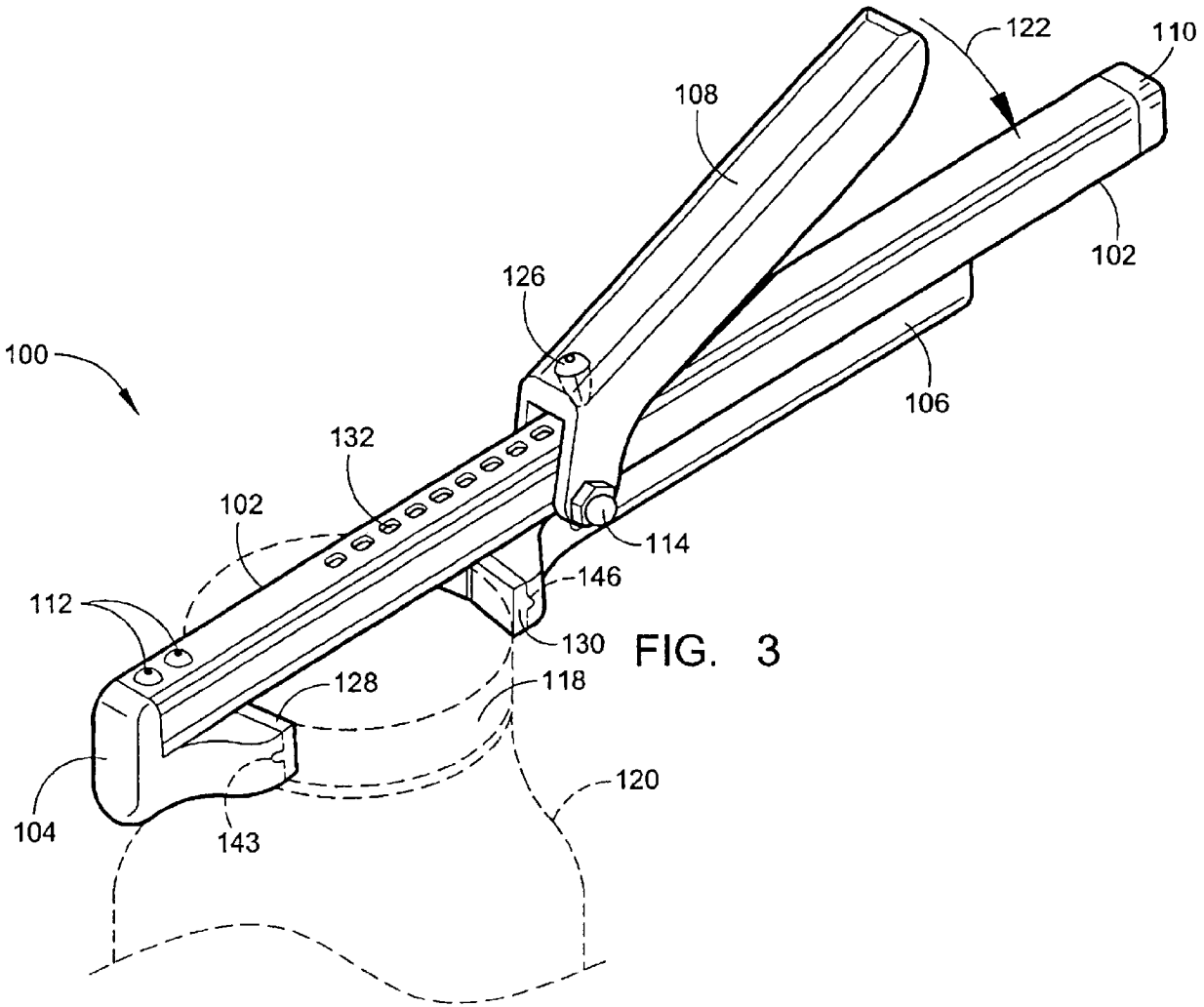
FIG. 3 is a perspective view of the Jar Opener of the present invention shown in use.

Referring next to FIG. 2, a top view of Jar Opener 100 is shown and illustrates the operation of Jar Opener 100. First, lid 118 of jar 120 is positioned against jaw edge 128 of fixed jaw 104. Second, with handle 108 in the open position (see FIG. 1 above) movable jaw 106 is advanced in direction 116 until jaw edge 130 of movable jaw 106 contacts lid 118. In this way, gap 125 is altered to fit diameter 127 of lid 118, thereby enabling Jar Opener 100 to engage virtually any size jar. Next, handle 108 is moved in direction 122 to closed position 124, discussed in conjunction with FIG. 1. As handle 108 is moved in direction 122, camming pin 126 inserts into one of the positioning holes 132. This action causes movable jaw 106 to be advanced slightly forward in direction 116, clamping lid 118 tightly between fixed jaw 104 and movable jaw 106, as well as fixing movable jaw 106 in place. Positioning holes 132 have gaps 133 between them and are discussed in conjunction with FIG. 4. It is important to note that Jar Opener 100 is able to securely hold lid 118 due to jaw width 129. Jaw width 129 represents the clamping surface of jaws 104 and 106, and is sufficiently large in proportion to the size of the lid. Jaw width 129 has large degrees or radians for a small size lid 118, and small degrees or radians for a large size lid 118. Finally, Jar Opener 100 is turned in direction 131, counterclockwise, in order to unscrew jar lid 118 from jar 120 (not shown in FIG. 2).

In a preferred embodiment, jaw edges 128 and 130 may be constructed of hard rubber. It is important to note, however, that they may be constructed of any material with the same amount of flexibility and grip as rubber. Either or both of jaw edges 128 and 130 may be constructed of plastic, metal, or soft rubber to facilitate the gripping of a jar between jaw edges 128 and 130.

Figure 4:
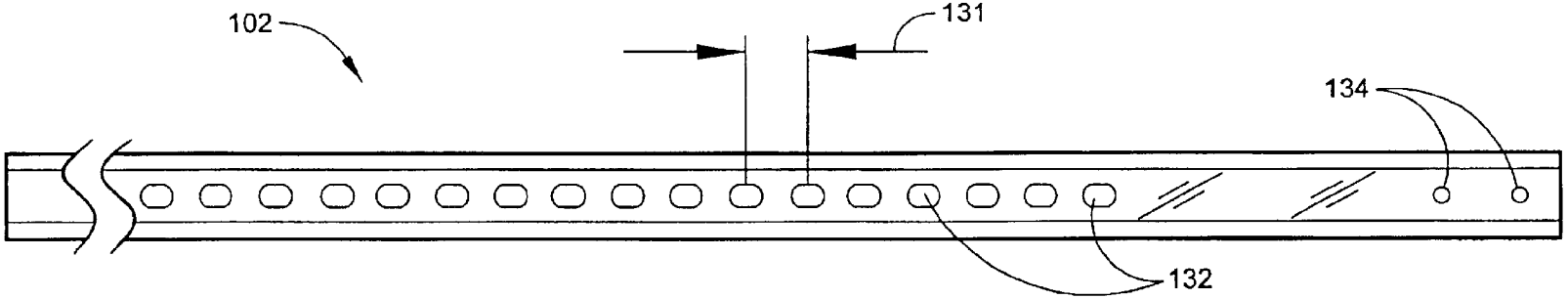
FIG. 4 is a top view of the beam of the Jar Opener of the present invention.

Referring next to FIG. 4, a top view of beam 102 of Jar Opener 100 is shown and includes positioning holes 132 and fixed jaw fastener holes 134. Positioning holes 132 are of sufficient size to receive camming pin 126 (not shown in FIG. 4), and of sufficient spacing 133 so that Jar Opener 100 may be used to open virtually any size jar. In a preferred embodiment, positioning holes 132 may measure 0.13 by 0.19 centimeters, and gaps 133 may be 0.15 centimeters apart on center. Also, in a preferred embodiment, beam 102 may be constructed of aluminum. However, it should be noted that beam 102 may be constructed of any material so long as it has a strength similar to aluminum.

Figure 5:
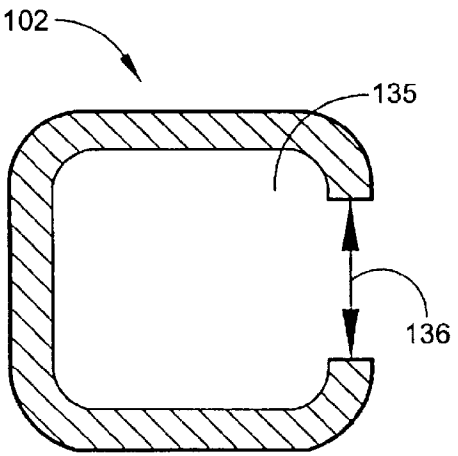
FIG. 5 is an end view of the beam of the Jar Opener of the present invention.

Referring now to FIG. 5, an end view of beam 102 of the present invention is shown and includes runner lumen 135 and opening 136. In a preferred embodiment, runner lumen 135 is sized to fit runner body 138 of fixed jaw 104, discussed in conjunction with FIG. 7, as well as runner body 140 of movable jaw 106, discussed in conjunction with FIG. 9.

Figure 6:
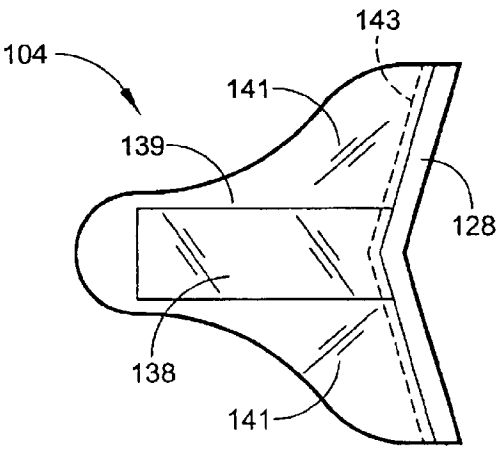
FIG. 6 is a top view of the fixed jaw of the Jar Opener of the present invention.

Referring now to FIG. 6, a top view of fixed jaw 104 is shown and includes runner body 138, lower body 139, jaw arms 141, and jaw edge 128. Runner body 138, lower body 139, and jaw arms 141 may be formed from one continuous piece or of separate pieces attached together by a means known in the art, including but not limited to welding or the use of an adhesive. Runner body 138 is formed above lower body 139, and is sized to fit within runner lumen 135 of beam 102. In a preferred embodiment, jaw edge 128 may be attached to jaw arms 141 by means of an adhesive. Although it should be noted that jaw edge 128 may be attached to jaw arms 141 by means of a screw, or any other fastener well known in the art. Jaw edge 128 has tabs which insert into channels located in jaw arms 141 as indicated by dashed line 143.

Figure 7:
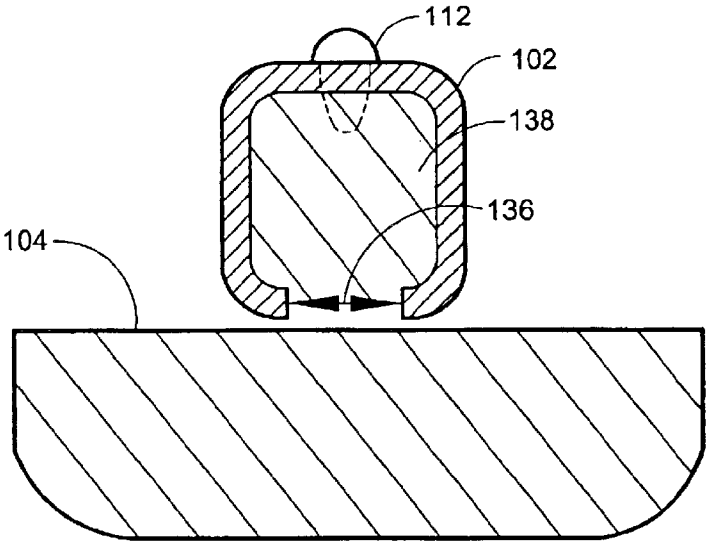
FIG. 7 is a cross sectional view of the Jar Opener of the present invention taken along line 7—7 of FIG. 1.

Referring next to FIG. 7, a cross sectional view of Jar Opener 100, taken along line 7—7 of FIG. 1, is shown and includes fixed jaw 104 and beam 102. Runner body 138 of fixed jaw 104 substantially fills runner lumen 135 (not shown in FIG. 5) of beam 102. Fixed jaw 104 is held in place both by screws 112, and by the fact that opening 136 of beam 102 is smaller in cross-section than runner body 138.

Figure 8:
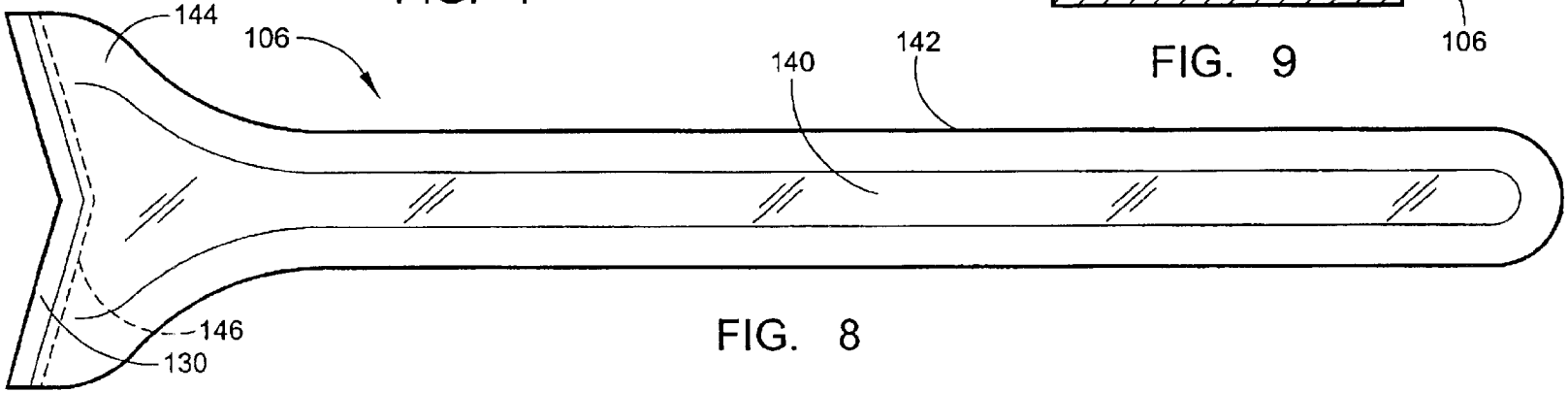
FIG. 8 is a top view of the movable jaw of the Jar Opener of the present invention.

Referring next to FIG. 8, a top view of movable jaw 106 is shown and includes runner body 140, lower body 142, jaw arms 144, and jaw edge 130. Runner body 140, lower body 142, and jaw arms 144 may be formed of one continuous piece, and runner body 140 may be formed to fit within runner lumen 135 (shown in FIG. 5) of beam 102. Also, jaw edge 130 may be attached to jaw arms 144 by means of an adhesive, however, jaw edge 130 may be fastened to jaw arms 144 by any means well known in the art. Jaw edge 130 has a tab which inserts into the channels of jaw arms 144 indicated by dashed line 146.

Figure 9:
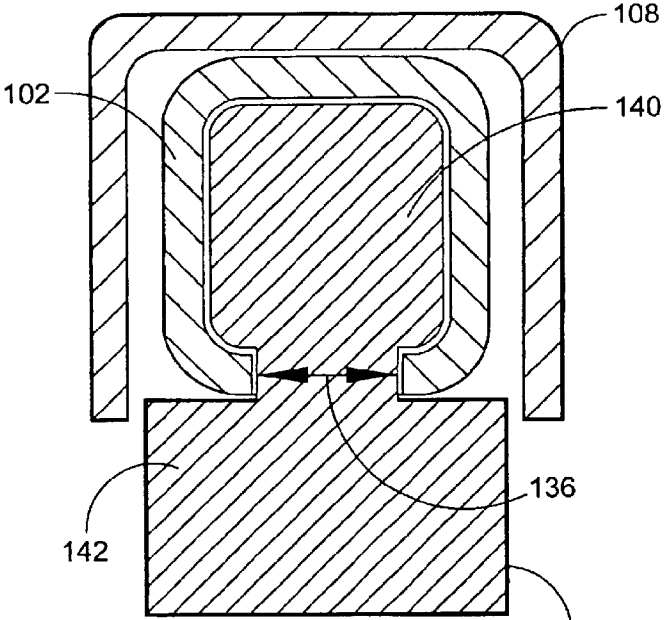
FIG. 9 is a cross sectional view of the Jar Opener of the present invention taken along line 9—9 of FIG. 1.

Referring next to FIG. 9, a cross sectional view taken along line 9—9 of FIG. 1, is shown and includes beam 102, movable jaw 106, and handle 108 in closed position 124. Runner body 140 of movable jaw 106 is fitted within beam 102, and since runner section 140 is wider than opening 136 in beam 102, runner section 140 is held within beam 102. Runner section 140 is used to add stability to Jar Opener 100, so that Jar Opener 100 may be used effectively even if handle 108 is not completely in the closed position 124, shown above in conjunction with FIG. 1.

Figure 10:
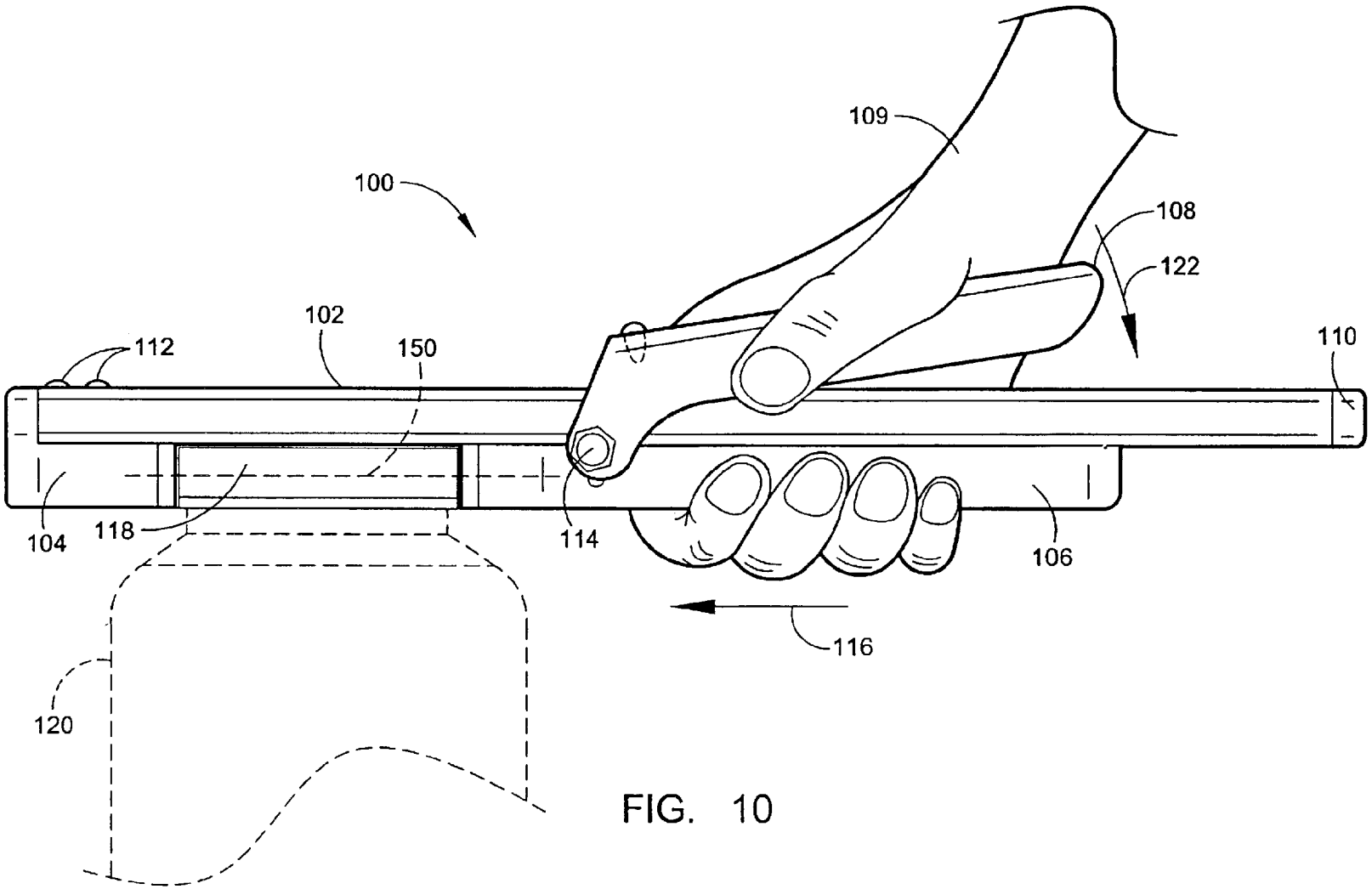
FIG. 10 is a side view of the Jar Opener of the present invention shown in operation and engaging the lid of a jar.

Referring next to FIG. 10, a side view of Jar Opener 100 is shown and includes but is not limited to plane of rotation 150 and handle 108 of Jar Opener 100. Turning movable jaw 106 and handle 108 in direction 131 results in plane of rotation 150. The plane of rotation 150 is located at the vertical center point of movable jaw 106 and lid 118 and rotates around the horizontal axis located at the center point of lid 118. Handle 108 has moved in direction 122 to a position halfway between the original position and closed position 124 (shown in FIG. 1).

OPERATION OF THE INVENTION

The operation of Jar Opener 100 begins with the separation of movable jaw 106 from fixed jaw 104 to receive lid 118 of jar 120. Once lid 118 is properly positioned against the underside of beam 102 and against fixed jaw 104, and with the handle 108 in a raised position to disengage camming pin 126 from any positioning holes 132, movable jaw 106 is moved along beam 102 in direction 116 until lid 118 is captured between fixed jaw 104 and movable jaw 106.

Once lid 118 is captured, the user grips the handle 108, beam 102 and movable jaw 106 (shown with hand 109) and squeezes handle 108 in direction 122 towards movable jaw 106. As handle 108 moves in direction 122, movable jaw 106 moves in direction 116 as camming pin 126 inserts into positioning hole 132 until fully inserted. The movement of movable jaw 106 in direction 116 tightens the grip of jaw edge 128 of fixed jaw 104, and jaw edge 130 of movable jaw 106, on lid 118 of jar 120. Once Jar Opener 100 has a secure grip on lid 118, the Jar Opener is turned in direction 131, or counterclockwise.

The force from rotating Jar Opener 100 extends through the center of lid 118 to create plane of rotation 150 (shown in dashed lines). Because the user actually grips the movable jaw 106 that contacts the lid 118, the rotational force is applied directly to the lid 118 in its plane of rotation 150. This feature is a distinguishing factor from previous devices, and serves to minimize the likelihood that the Jar Opener 100 will disengage from the lid 118 during the opening process.

While the Jar Opener of the present invention as herein shown and disclosed in detail is fully capable of obtaining and providing the advantages herein before stated, it is to be understood that it is merely illustrative of a preferred embodiment of the invention and that no limitations are intended to the details of construction or design herein shown other than as described in the appended claims.

I claim:

1. A jar opener, comprising:

a fixed jaw for engaging a first side of a lid on a jar;

a movable jaw for releasably engaging a second side of said lid opposite said first side and formed with a runner section;

a handle for pressing said movable jaw against said second side of said lid; and a beams for supporting said fixed jaw and formed with a lumen to slidably receive said runner section of said movable jaw and said handle, wherein said beams is turned relative to said jar to open said jar.

2. A jar opener for opening a jar having a lid, comprising:

a beam having a first end and a second end and formed with a lumen, and having a plurality of elongated positioning holes;

a fixed jaw fixed to said first end;

a movable jaw having a runner section slidably disposed in said lumen of said beam and translatable between said first end and said second end; and a handle pivotally affixed to said movable jaw and having a fixed camming pin engageable to said positioning holes wherein pivoting said handle toward said beam advances said movable jaw toward said fixed jaw to capture said lid therebetween.

3. A jar opener as in claim 2, wherein:

said fixed jaw further comprises jaw arms means for releasably engaging said first surface; and said movable jaw further comprises jaw arms means for releasably engaging said second surface.

4. A jar opener as in claim 2, further comprising:

at least one fixed screw, at least partially whereby said fixed jaw is fixed to said first end.

5. A jar opener as in claim 2, wherein:

at least one of said beam and said handle comprises aluminum.

6. A jar opener as in claim 2, wherein:

at least one of said handle and said movable jaw comprises a textured surface.

7. A jar opener as in claim 2, wherein:

at least one of said fixed jaw and said movable jaw comprises hard plastic.

8. A jar opener as in claim 2, wherein:

said jar opener is adaptable to open any size jar known in the art.

9. A jar opener as in claim 2, wherein:

said handle is adapted to releasably engage said beam, whereby said handle is operable to releasably press said movable jaw against said second surface.

10. A jar opener as in claim 9, further comprising:

a camming pin, whereby said handle is adapted to releasably engage said beam; and a plurality of positioning holes in said beam, each of said plurality of positioning holes adapted to removably receive said camming pin, whereby said handle releasably engages said beam.

11. A jar opener as in claim 2, wherein:

said fixed jaw comprises a fixed jaw edge, whereby said fixed jaw is adapted to releasably engage said first surface; and said movable jaw comprises a movable jaw edge, whereby said movable jaw is adapted to releasably engage said second surface.

12. A jar opener as in claim 11, wherein:

at least one of said fixed jaw edge and said movable jaw edge comprises hard rubber.

13. A jar opener as in claim 2, further comprising:

an end plug affixed to said second end of said beam.

14. A jar opener as in claim 13, wherein:

said end plug comprises hard plastic.

15. A jar opener as in claim 2, wherein:

said handle is pivotally affixed to said movable jaw by a fastener.

16. A jar opener as claim 15, wherein:

said fastener comprises a bolt and a nut.

17. A jar opener as in claim 15, wherein:

said fastener comprises a rivet.

* * * * *